US011027759B2

(12) United States Patent
Bohme et al.

(10) Patent No.: US 11,027,759 B2
(45) Date of Patent: Jun. 8, 2021

(54) SPRING-LOADED GATE RETRACTION DEVICE TO RETURN A RAIL-ROAD CROSSING GATE ARM

(71) Applicant: Siemens Mobility, Inc., New York, NY (US)

(72) Inventors: Richard C. Bohme, Louisville, KY (US); Zhenzhong Long, Louisville, KY (US)

(73) Assignee: Siemens Mobility, Inc., New York, NY (US)

( * ) Notice: Subject to any disclaimer, the term of this patent is extended or adjusted under 35 U.S.C. 154(b) by 0 days.

(21) Appl. No.: 16/976,677

(22) PCT Filed: Mar. 29, 2018

(86) PCT No.: PCT/US2018/025128
§ 371 (c)(1),
(2) Date: Aug. 28, 2020

(87) PCT Pub. No.: WO2019/190523
PCT Pub. Date: Oct. 3, 2019

(65) Prior Publication Data

US 2021/0001907 A1 Jan. 7, 2021

(51) Int. Cl.
*B61L 29/04* (2006.01)
*B61L 29/08* (2006.01)

(52) U.S. Cl.
CPC ..... *B61L 29/04* (2013.01); *B61L 29/08* (2013.01)

(58) Field of Classification Search
CPC ..... B61L 29/00; B61L 29/02; B61L 29/023; B61L 29/04; B61L 29/08
See application file for complete search history.

(56) References Cited

U.S. PATENT DOCUMENTS

| | | | | |
|---|---|---|---|---|
| 4,897,960 | A | 2/1990 | Barvinek et al. | |
| 8,240,618 | B1 * | 8/2012 | Luetzow | E05F 1/10 246/111 |
| 2004/0118048 | A1 | 6/2004 | Ronald et al. | |
| 2013/0055640 | A1 | 3/2013 | Deitchman | |
| 2017/0313333 | A1 | 11/2017 | Brandt et al. | |

OTHER PUBLICATIONS

PCT International Search Report and Written Opinion of International Searching Authority dated Jan. 7, 2019 corresponding to PCT International Application No. PCT/US2018/025128 filed Mar. 29, 2018.

* cited by examiner

*Primary Examiner* — Robert J McCarry, Jr.

(57) ABSTRACT

A gate retraction device is provided to return a crossing gate arm to a home position. The gate retraction device comprises a frame to hold a gate pivot pin that is configured to provide a bi-directional rotation of the crossing gate arm. The gate retraction device further comprises a main pivot assembly that receives the gate pivot pin on one end so as to enable rotation of the main pivot assembly in a horizontal plane. The main pivot assembly comprises a first side and a second side opposite of the first side and wherein the main pivot assembly further comprises a spring pin extending on the first side and the second side of the main pivot assembly. The gate retraction device further comprises a spring-loaded assembly trapped against the spring pin of the main pivot assembly as the main pivot assembly rotates.

14 Claims, 7 Drawing Sheets

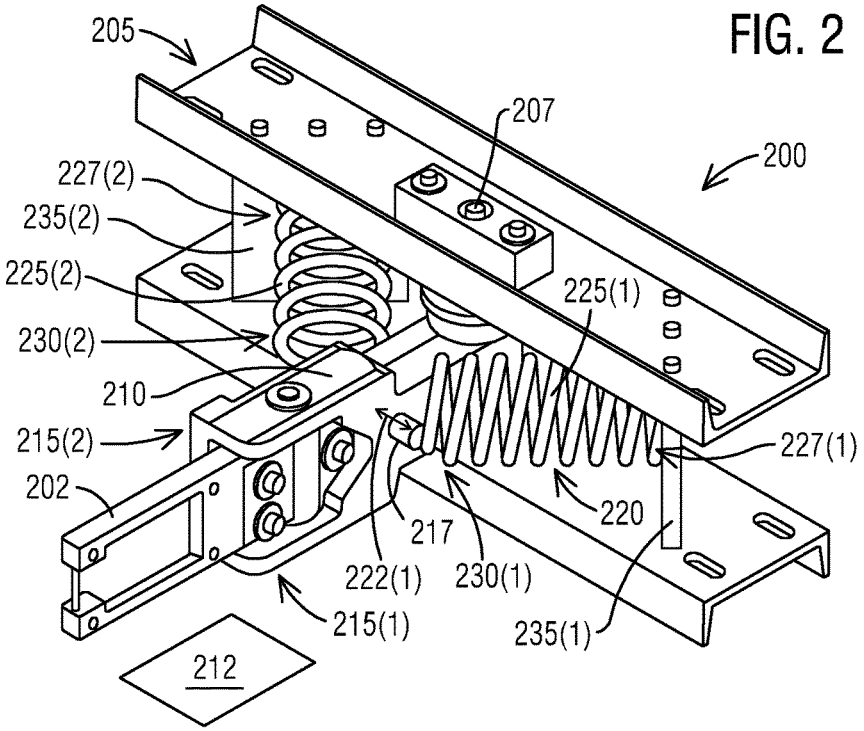
FIG. 2
FIG. 1
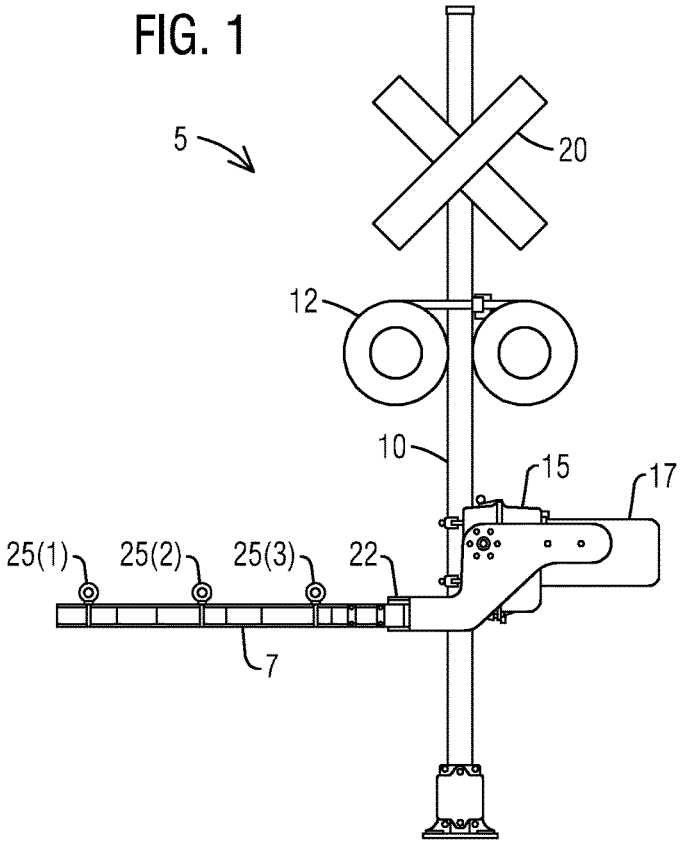

SPRING-LOADED GATE RETRACTION DEVICE TO RETURN A RAIL-ROAD CROSSING GATE ARM

BACKGROUND

1. Field

Aspects of the present invention generally relate to a spring-loaded gate retraction device configured to return a rail-road crossing gate arm to a home position and is capable of bi-directional operation with 60 degree rotation on both sides.

2. Description of the Related Art

Current spring-loaded gate return devices are rotation limited to 45 degrees, sometimes fail to return a gate arm due to a spring popping out of a detent and also fail to return from an angle above horizontal if activated. Additionally a railroad worker needs to replace a shear pin in the assembly.

General Railway Signals (GSI) has a bi-directional gate saver but only rotates 45 degrees and has return issues. National Electric Gate Company (NEG) has a bi-directional gate saver but only rotates in 45 degrees and also uses a shear pin. Western Cullen Hayes (WCH) has a bi-directional gate saver that rotates 60 degrees from center, uses a shear pin, is heavier and requires more counter weights. The WCH design does not return from 60 degrees off center while elevated 60 degrees above horizontal. The NEG unit does have a swivel feature for maintenance but poor design causes the 2 locking bolts to shear and does not rotate easily with long gate arms.

Therefore, there is a need for a robust bi-directional gate return device not prone to spring popping but and has up to 60 degree rotation in both directions from center and with up to 60 degrees from horizontal.

SUMMARY

Briefly described, aspects of the present invention relate to a spring-loaded gate retraction device to return a rail-road crossing gate arm using a two-ended pin instead of a notch to catch a spring pair when a main pivot assembly rotates along with a pair of spring catching washers which keep each spring from moving on a corresponding end plate of a frame holding a gate pivot pin that is configured to provide a bi-directional 60 degree rotation of the rail-road crossing gate arm.

In accordance with one illustrative embodiment of the present invention, a spring-loaded gate retraction device to return a rail-road crossing gate arm is provide. The spring-loaded gate retraction device comprises a frame to hold a gate pivot pin that is configured to provide a bi-directional rotation of the rail-road crossing gate arm. The spring-loaded gate retraction device further comprises a main pivot assembly that receives the gate pivot pin on one end so as to enable rotation of the main pivot assembly in a horizontal plane substantially parallel to a ground surface of a road. The main pivot assembly comprises a first side and a second side opposite of the first side. The main pivot assembly further comprises a pin extending on the first side and the second side of the main pivot assembly. The pin has a first length on the first side of the main pivot assembly and a second length on the second side of the main pivot assembly. The spring-loaded gate retraction device further comprises a first spring having a first end and a second end. The first spring is disposed horizontally lengthwise on the first side of the main pivot assembly and coupled to the frame on the first end of the first spring and detachably coupled to the first length of the pin of the main pivot assembly on the second end of the first spring. The spring-loaded gate retraction device further comprises a second spring having a first end and a second end. The second spring is disposed horizontally lengthwise on the second side of the main pivot assembly and coupled to the frame on the first end of the second spring and detachably coupled to the second length of the pin of the main pivot assembly on the second end of the second spring.

In accordance with another illustrative embodiment of the present invention, a gate retraction device is provided to return a crossing gate arm. The gate retraction device comprises a frame to hold a gate pivot pin that is configured to provide a bi-directional rotation of the crossing gate arm. The gate retraction device further comprises a main pivot assembly that receives the gate pivot pin on one end so as to enable rotation of the main pivot assembly in a horizontal plane. The main pivot assembly comprises a first side and a second side opposite of the first side and wherein the main pivot assembly further comprises a spring pin extending on the first side and the second side of the main pivot assembly. The gate retraction device further comprises a spring-loaded assembly trapped against the spring pin of the main pivot assembly as the main pivot assembly rotates.

In accordance with another illustrative embodiment of the present invention, a method of returning a crossing gate arm to a home position with a gate retraction device is provided. The method comprises providing a frame to hold a gate pivot pin that is configured to provide a bi-directional rotation of the crossing gate arm, providing a main pivot assembly that receives the gate pivot pin on one end so as to enable rotation of the main pivot assembly in a horizontal plane. The main pivot assembly comprises a first side and a second side opposite of the first side and wherein the main pivot assembly further comprises a spring pin extending on the first side and the second side of the main pivot assembly. The method further comprises trapping a spring-loaded assembly against the spring pin of the main pivot assembly as the main pivot assembly rotates.

BRIEF DESCRIPTION OF THE DRAWINGS

FIG. 1 illustrates a representation of a front view of an entrance crossing gate for a gate arm in accordance with an exemplary embodiment of the present invention.

FIG. 2 illustrates a representation of a perspective view of a spring-loaded gate retraction device to return a rail-road crossing gate arm in accordance with an exemplary embodiment of the present invention.

DETAILED DESCRIPTION

Figure 3:
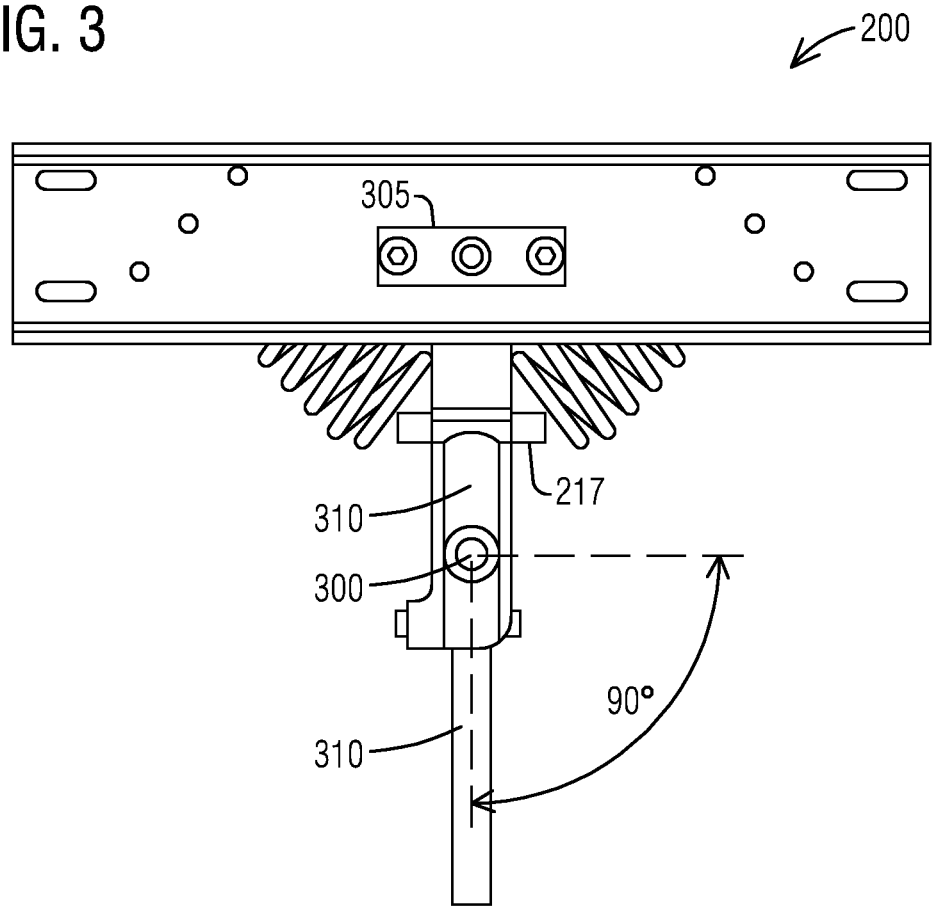
FIG. 3 illustrates a representation of a top view of a spring-loaded gate retraction device to return a rail-road crossing gate arm in accordance with an exemplary embodiment of the present invention.

To facilitate an understanding of embodiments, principles, and features of the present invention, they are explained hereinafter with reference to implementation in illustrative embodiments. In particular, they are described in the context of a gate retraction device configured for returning a crossing gate arm to a home position. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Consistent with one embodiment of the present invention, FIG. 1 represents a representation of a front view of an entrance crossing gate 5 for a gate arm 7 in accordance with an exemplary embodiment of the present invention. The entrance crossing gate 5 comprises a mast 10 and a signal light 12 mounted on it. The entrance crossing gate 5 further comprises a gate mechanism 15 and a counterweight kit 17. The entrance crossing gate 5 further comprises a "RAILROAD CROSSING" sign 20. The entrance crossing gate 5 further comprises a gate arm keeper or a spring-loaded gate retraction device or a gate return device 22. The entrance crossing gate 5 further comprises a plurality of lamps 25(1-3) mounted on the gate arm 7.

The spring-loaded gate return or retraction device 22 is not rotation limited to 45 degrees but can rotate up to 60 degrees in two directions. The spring-loaded gate return or retraction device 22 is configured not to fail to return the gate arm 7 due to a spring popping out of a notch or a detent (see FIG. 2) and also not to fail to return from an angle above horizontal if activated.

Referring to FIG. 2, it illustrates a representation of a perspective view of a spring-loaded gate return or retraction device 200 to return a rail-road crossing gate arm (not shown, but see the gate arm 7 in FIG. 1) coupled to an arm tang 202 in accordance with an exemplary embodiment of the present invention. The spring-loaded gate return or retraction device 200 comprises a frame 205 to hold a gate pivot pin 207 that is configured to provide a bi-directional rotation of the crossing gate arm 7 of FIG. 1. The spring-loaded gate return or retraction device 200 further comprises a main pivot assembly 210 that receives the gate pivot pin 207 on one end so as to enable rotation of the main pivot assembly 210 in a horizontal plane 212. The main pivot assembly 210 comprises a first side 215(1) and a second side 215(2) opposite of the first side 215(1).

The main pivot assembly 210 further comprises a spring pin 217 extending on the first side 215(1) and the second side 215(2) of the main pivot assembly 210. The spring-loaded gate return or retraction device 200 further comprises a spring-loaded assembly 220 trapped against the spring pin 217 of the main pivot assembly 210 as the main pivot assembly 210 rotates. The spring pin 217 has a first length 222(1) on the first side 215(1) of the main pivot assembly 210 and a second length 222(2) (similar to 222(1) but not seen) on the second side 215(2) of the main pivot assembly 210.

The spring-loaded assembly 220 comprises a first spring 225(1) having a first end 227(1) and a second end 230(1). The first spring 225(1) is disposed horizontally lengthwise on the first side 215(1) of the main pivot assembly 210 and coupled to the frame 205 on the first end 227(1) of the first spring 225(1) and detachably coupled to the first length 222(1) of the spring pin 217 of the main pivot assembly 210 on the second end 230(1) of the first spring 225(1). The spring-loaded assembly 220 further comprises a second spring 225(2) having a first end 227(2) and a second end 230(2). The second spring 225(2) is disposed horizontally lengthwise on the second side 215(2) of the main pivot assembly 210 and coupled to the frame 205 on the first end 227(2) of the second spring 225(2) and detachably coupled to the second length 222(2) of the spring pin 217 of the main pivot assembly 210 on the second end 230(2) of the second spring 225(2). In one embodiment, the spring pin 217 of the main pivot assembly 210 is located near a center at a middle of a longitudinal length of the main pivot assembly 210.

The frame 205 may further comprise a first end plate 235(1) angled rearwards towards the centerline of the spring-loaded gate return or retraction device 200 to receive the first end 227(1) of the first spring 225(1). The frame 205 may further comprise a second end plate 235(2) angled rearwards towards the centerline of the spring-loaded gate return or retraction device 200 to receive the first end 227(2) of the second spring 225(2).

In one embodiment, the first spring 225(1) and the second spring 225(2) are a coil spring. The first spring 225(1) may be trapped against the spring pin 217 of the main pivot assembly 210 as the main pivot assembly 210 rotates. The second spring 225(2) is trapped against the spring pin 217 of the main pivot assembly 210 as the main pivot assembly 210 rotates.

Returning to FIG. 3, it illustrates a representation of a top view of the spring-loaded gate return or retraction device 200 of FIG. 2 to return a rail-road crossing gate arm such as the gate arm 7 of FIG. 1 in accordance with an exemplary embodiment of the present invention. The crossing gate arm 7 is detachably coupled to the main pivot assembly 210 such that the rail-road crossing gate arm such as the crossing gate arm 7 is removable from the main pivot assembly 210 so that the main pivot assembly 210 can swivel during arm maintenance. A 90 degree maintenance swivel 310 is provided using a maintenance pivot pin 300. The spring-loaded gate return or retraction device 200 further comprises a top bearing 305.

Figure 4:
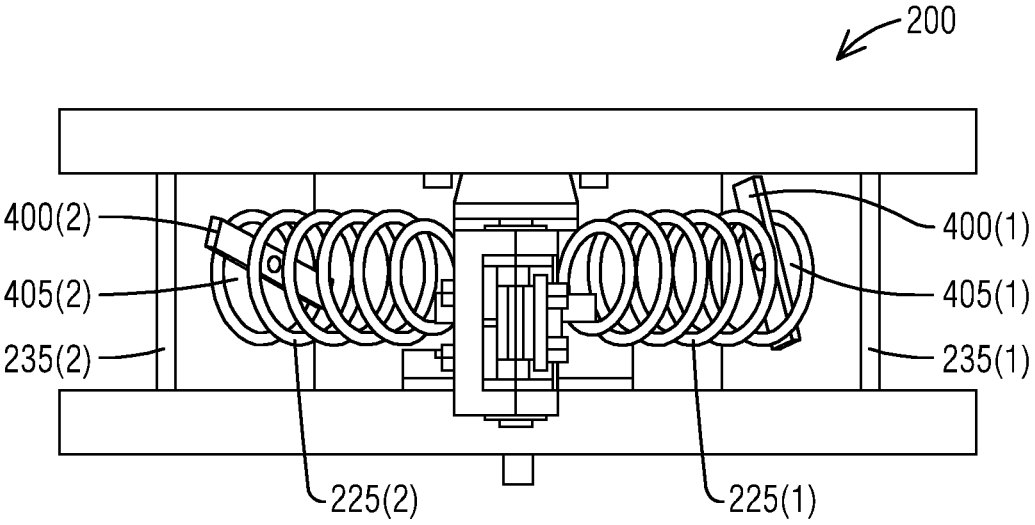
FIG. 4 illustrates a representation of a front view of a spring-loaded gate retraction device to return a rail-road crossing gate arm in accordance with an exemplary embodiment of the present invention.

FIG. 4 illustrates a representation of a front view of the spring-loaded gate return or retraction device 200 to return the rail-road crossing gate arm in accordance with an exemplary embodiment of the present invention. The spring-loaded gate return or retraction device 200 comprises a first clip 400(1) and a second clip 400(2). The first clip 400(1) holds the first spring 225(1) in position via a first screw. The second clip 400(2) holds the second spring 225(2) in position via a second screw. The spring-loaded gate return or retraction device 200 further comprises a first centering washer 405(1) coupled to the first end plate 235(1) to hold position of the first spring 225(1) with the first clip 400(1) by keeping the first spring 225(1) from moving on the first end plate 235(1). The spring-loaded gate return or retraction device 200 further comprises a second centering washer 405(2) coupled to the second end plate 235(2) to hold position of the second spring 225(2) with the second clip 400(2) by keeping the second spring 225(2) from moving on the second end plate 235(2).

Figure 5:
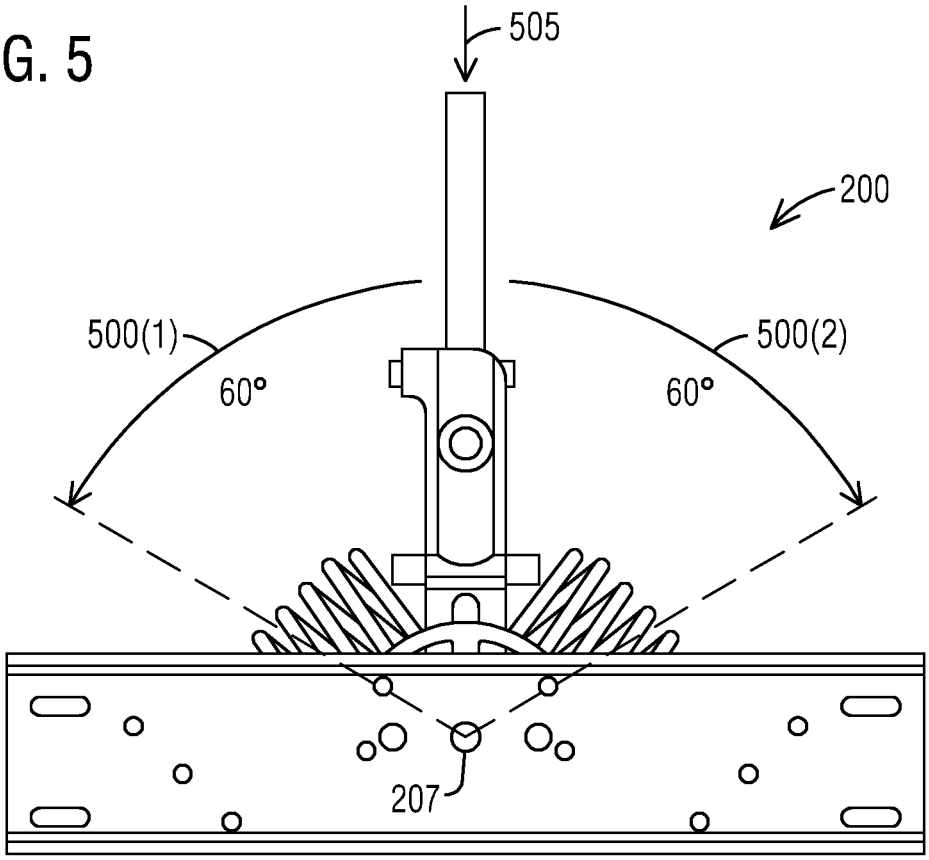
FIG. 5 illustrates a representation of a bottom view of a spring-loaded gate retraction device to return a rail-road crossing gate arm in accordance with an exemplary embodiment of the present invention.

As seen in FIG. 5, it illustrates a representation of a bottom view of the spring-loaded gate return or retraction device 200 to return the crossing gate arm 7 in accordance with an exemplary embodiment of the present invention. The gate pivot pin 207 provides a 60 degree rotation in a left direction 500(1) from a home position 505 of 0 degree and a 60 degree rotation in a right direction 500(2) from the home position 505.

Figure 6:
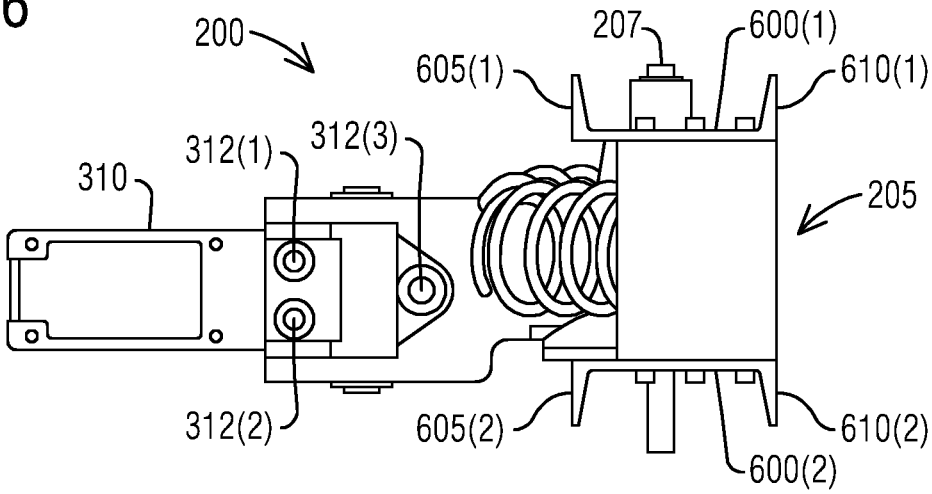
FIG. 6 illustrates a representation of a side view of a spring-loaded gate retraction device to return a rail-road crossing gate arm in accordance with an exemplary embodiment of the present invention.

As shown in FIG. 6, it illustrates a representation of a side view of the spring-loaded gate return or retraction device 200 to return the crossing gate arm 7 in accordance with an exemplary embodiment of the present invention. The frame 205 comprises a first channel 600(1) and a second channel 600(2). Each channel 600 of the first and second channels 600(1), 600(2) has a first flange 605(1, 2) and a second flange 610(1, 2) such that a pivot point of the gate pivot pin 207 is closer to the first flange 605(1) of the first channel 600(1). The 90 degree maintenance swivel 310 is provided 3 bolts 312(1-3) that can be removed to allow the gate arm 7 to rotate 90 degrees off the road for maintenance purposes. This can be done after the internal gear train of the gate mechanism is locked. If the gear train was not locked, once the gate arm 7 is rotated to a certain point, the complete assembly would no longer be gate side heavy and would want to rise up. This can only rotate in one direction, away from the train tracks.

Figure 7:
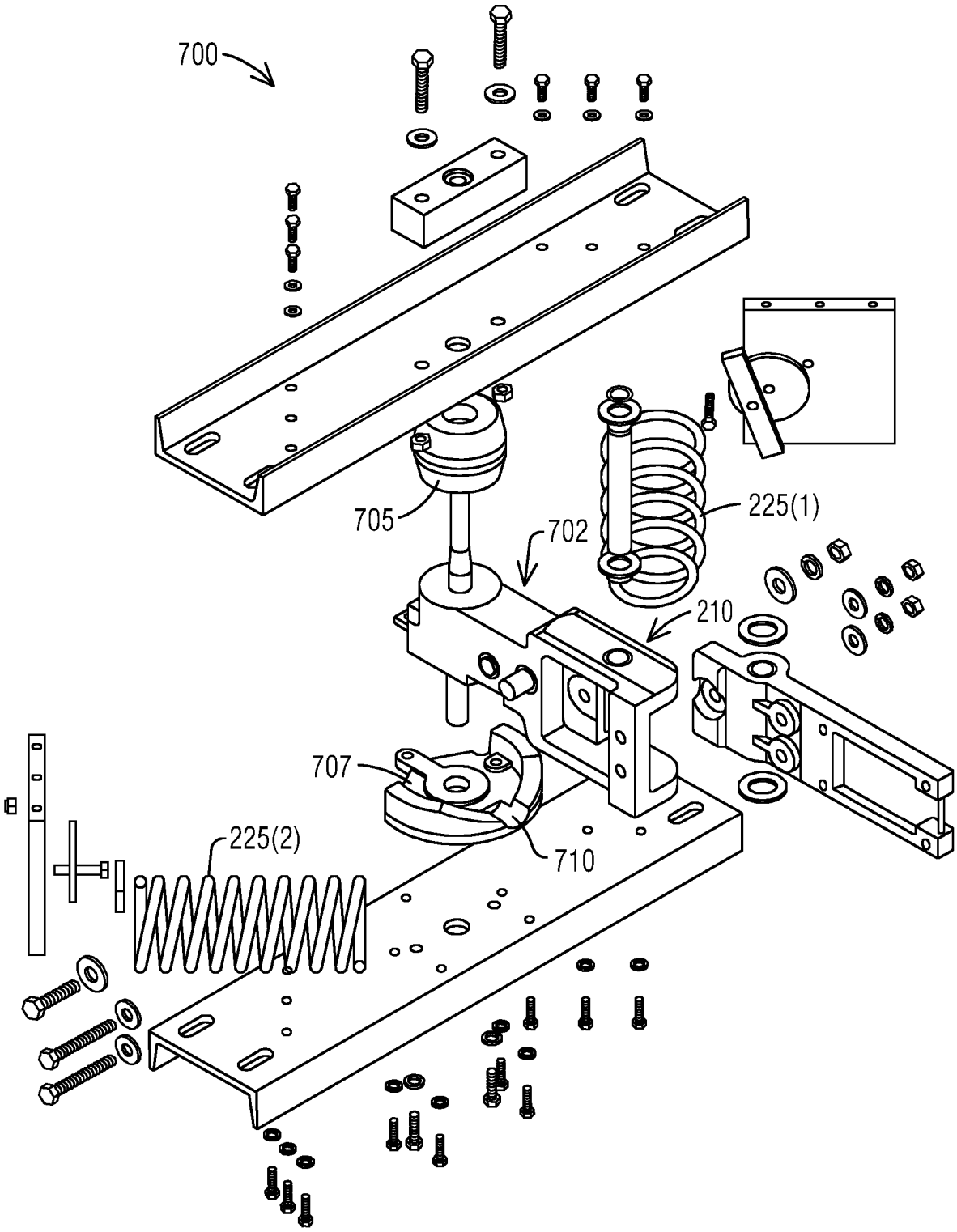
FIG. 7 illustrates a representation of an exploded view of the spring-loaded gate retraction device of FIG. 2 in accordance with an exemplary embodiment of the present invention.

In FIG. 7, it illustrates a representation of an exploded view 700 of the spring-loaded gate return or retraction device 200 of FIG. 2 in accordance with an exemplary embodiment of the present invention. The main pivot assembly 210 comprises a roller assembly 702 including a yoke and a roller such that a pin going through the yoke holds the roller assembly 702 in place. The spring-loaded gate return or retraction device 200 comprises a rubber spring 705 and a ramp 707 having a detent 710 such that the roller of the roller assembly 702 fits into the detent 710. When a force is applied to the crossing gate arm 7, the rubber spring 705 is compressed in order for the roller to move out of the ramp 707 and compress one of the first spring 225(1) or the second spring 225(2).

Figure 8:
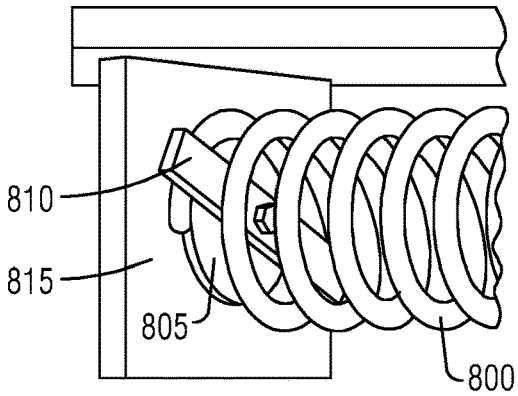
FIG. 8 illustrates a representation of a perspective view of the coil spring and a spring centering washer with a clip in accordance with an exemplary embodiment of the present invention.

With regards to FIG. 8, it illustrates a representation of a perspective view of a coil spring 800 and a spring centering washer 805 with a clip 810 in accordance with an exemplary embodiment of the present invention. The spring centering washer 805 is coupled to an end plate 815 to hold position of the coil spring 800 with the clip 810 by keeping the coil spring 800 from moving on the end plate 815.

Figure 9:
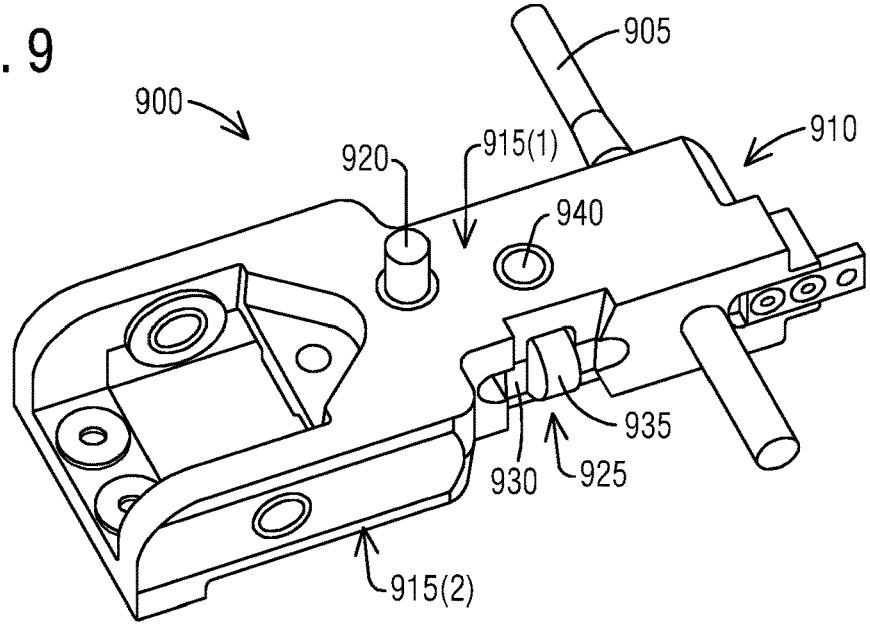
FIG. 9 illustrates a representation of a perspective view of a main pivot assembly in accordance with an exemplary embodiment of the present invention.

With respect to FIG. 9, it illustrates a representation of a perspective view of a main pivot assembly 900 in accordance with an exemplary embodiment of the present invention. The main pivot assembly 900 receives a gate pivot pin 905 on one end 910 so as to enable rotation of the main pivot assembly 900 in a horizontal plane substantially parallel to a ground surface of a road. The main pivot assembly 900 comprises a first side 915(1) and a second side 915(2) opposite of the first side 915(1).

The main pivot assembly 900 further comprises a pin 920 extending on the first side 915(1) and the second side 915(2) of the main pivot assembly 900. The main pivot assembly 900 further comprises a roller assembly 925 including a yoke 930 and a roller 935 such that a pin 940 going through the yoke 930 holds the roller assembly 925 in place. In the main pivot assembly 900, at the gate pivot pin 905 is where the rotation happens if the gate arm 7 struck by a vehicle or an object. The pin 920 sticking out of the middle of the main pivot assembly 900 is the pin that catches the coil of the spring 225 if rotated. The roller assembly 925 is just visible in the FIG. 9 is held in position by the pin 940 that is to the right of the pin 920.

Figure 10:
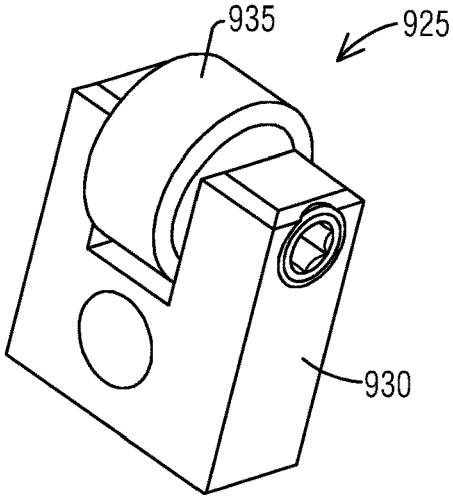
FIG. 10 illustrates a representation of a perspective view of a roller assembly in accordance with an exemplary embodiment of the present invention.

FIG. 10 illustrates a representation of a perspective view of the roller assembly 925 in accordance with an exemplary embodiment of the present invention. The roller assembly 925 includes the yoke 930 and the roller 935 such that a pin (not shown) going through the yoke 930 holds the roller assembly 925 in place. The roller assembly 925 is a small sub-assembly that get installed in the main pivot assembly 900. The roller 935 rides on a socket head cap screw acting as an axle for the roller 935.

Figure 11:
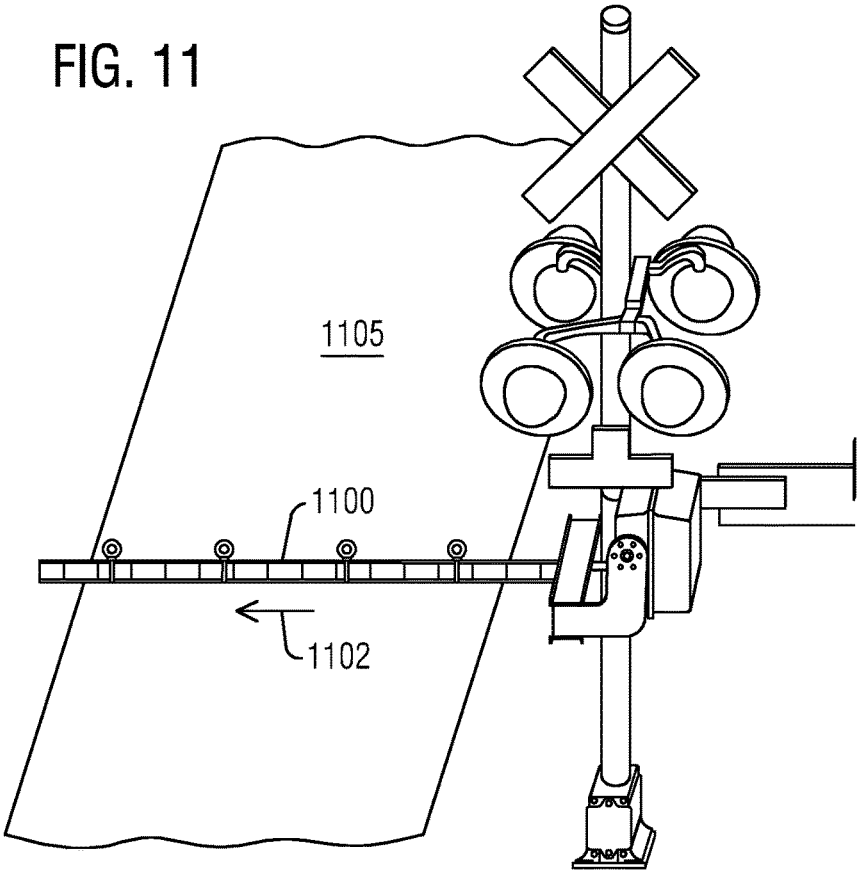
FIG. 11 illustrates a representation of a perspective view of a gate arm in the horizontal position to a road in that the gate arm is in the 0 degree or in a home position in accordance with an exemplary embodiment of the present invention.

FIG. 11 illustrates a representation of a perspective view of a gate arm 1100 in a horizontal position 1102 to a road 1105 in that the gate arm 1100 is in the 0 degree or in a home position in accordance with an exemplary embodiment of the present invention. FIG. 11 shows a gate mechanism that has been lowered to a horizontal position such that the gate arm 7 in parallel to a road surface. This is the normal operation of the gate mechanism. There is not a force applied to the gate arm 7 so the gate arm 7 did not rotate from its home or 0 position. The coil springs 225 are not in contact with the main pivot assembly 900 and the roller 935 is in the detent 710 of the ramp 707.

Figure 12:
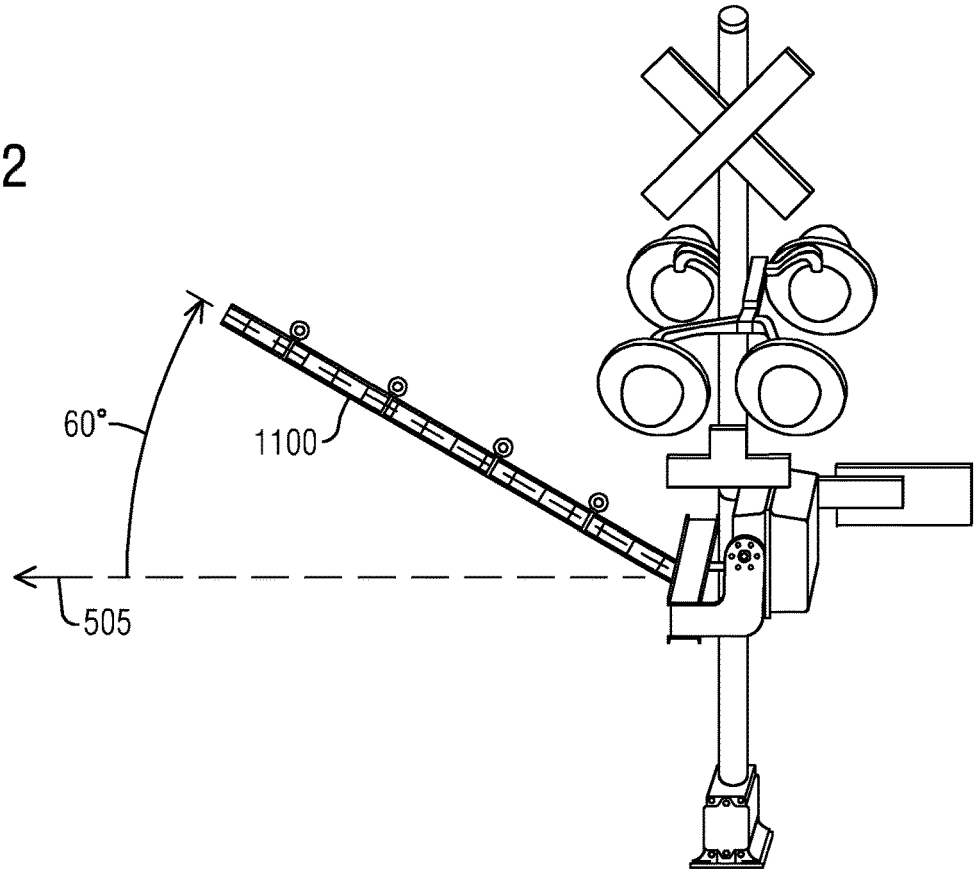
FIG. 12 illustrates a representation of a perspective view of a gate arm in the horizontal position but had been struck by a vehicle and rotated 60 degrees about a pivot shaft in accordance with an exemplary embodiment of the present invention.

FIG. 12 illustrates a representation of a perspective view of the gate arm 1100 in the horizontal position 1102 but had been struck by a vehicle and rotated 60 degrees about a pivot shaft in accordance with an exemplary embodiment of the present invention. In the view in FIG. 12, a force has been applied to the side of the gate arm 7. One of the 2 coils springs 225 has been compressed, the main pivot assembly 900 has moved up such that the roller 935 has come out of the detent 710 in the ramp 707 and rotated up the ramp surface. The rubber spring 705 above the main pivot assembly 900 has been compressed as the roller 935 has come out of the detent 710 and up the ramp 707. In one embodiment, the maximum rotation is 60 degrees. At 60 degrees, the springs 225 have been compressed to the maximum state and maximum force is exerted on the gate arm 7 trying to return it to the 0 or home position 505.

Figure 13:
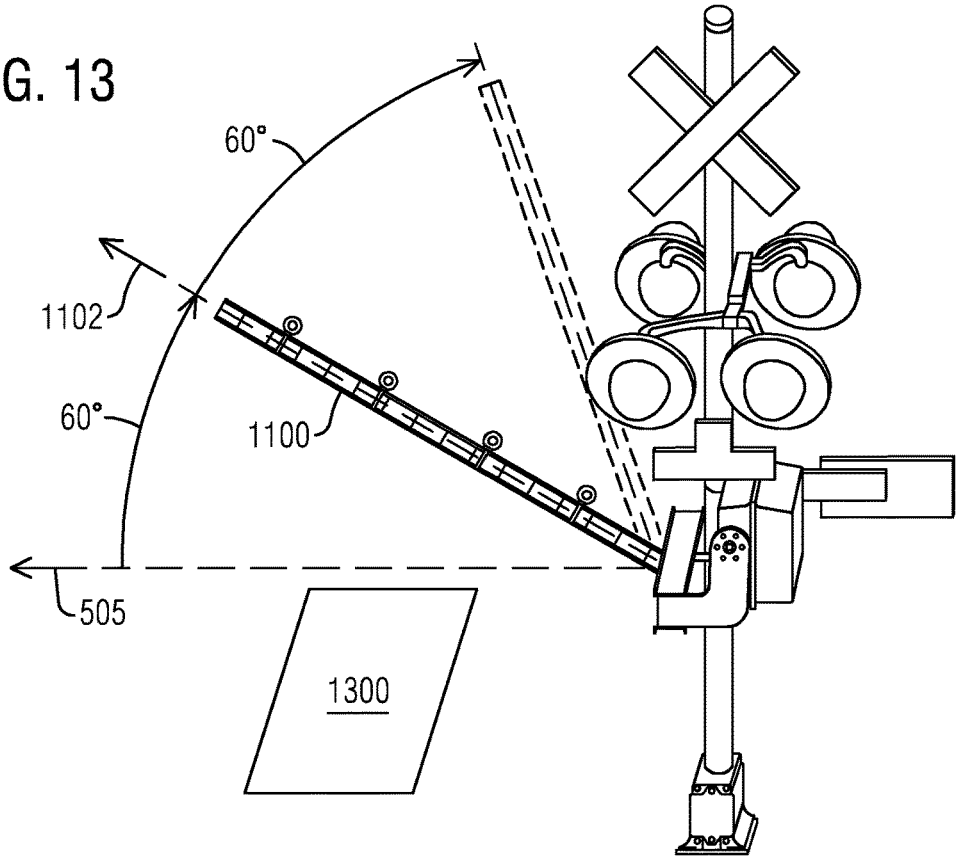
FIG. 13 illustrates a representation of a perspective view of a gate arm in the horizontal position but had been struck by a vehicle and rotated 60 degrees about a pivot shaft and a complete mechanism has rotated 60 degrees up from a horizontal plane in accordance with an exemplary embodiment of the present invention.

FIG. 13 illustrates a representation of a perspective view of the gate arm 1100 in the horizontal position 1102 but had been struck by a vehicle and rotated 60 degrees about a pivot shaft and a complete mechanism has rotated 60 degrees up from a horizontal plane 1300 in accordance with an exemplary embodiment of the present invention.

In the example of FIG. 13, the gate arm 7 is rotated 60 degrees as per the last FIG. 12 but the gate mechanism, gate arm, support arm and counter weights have been rotated up 60 degrees about the main shaft of the gate mechanism. To show this effect, the gate arm 7 is placed in this 60 degree rotated over and 60 degree up position. This could be an example of the gate arm 7 coming down from the vertical position on top of a truck or a car hitting the gate arm 7 so it rotated in the direction of the car traveling and pushing the gate arm 7 up from horizontal. The typical entrance gates are counter weighted so it is gate side heavy (about the main shaft) and the gate arm 7 is held in the horizontal position by gravity. During the gate closing or lowering cycle, a motor powers the gate arm 7 down from vertical (90 degrees) to 70 degrees and the remaining movement of the gate arm 7 from 70 degrees to 0 or horizontal is done by gravity (the weight of the gate arm 7). With the gate arm 7 in the horizontal position, it can be pushed up by a person or force from the underside of the gate. Again, the complete gate assembly is counter weighted to be gate side heavy (a range of torque). If the gate arm 7 is rotated, the center of gravity moves towards the main shaft pivot point. This center of gravity shifts towards the main shaft pivot point even further if the gate arm 7 is forced to raise up. It is now possible that the resultant force balance results in the gate arm 7 side being light or want to rise to the vertical position and opening the crossing to traffic. This would be the worst situation. The springs 225 are able to exert enough force to rotate the gate arm 7 to the 0 position 505, the roller 935 has moved back into the detent 710 of the ramp 707. Once this has happened, the center of the gate arm 7 has moved away from the pivot point of the main shaft making the complete gate mechanism assembly gate side heavy again and gravity now brings the gate arm 7 to the horizontal position as in FIG. 13.

Figure 14:
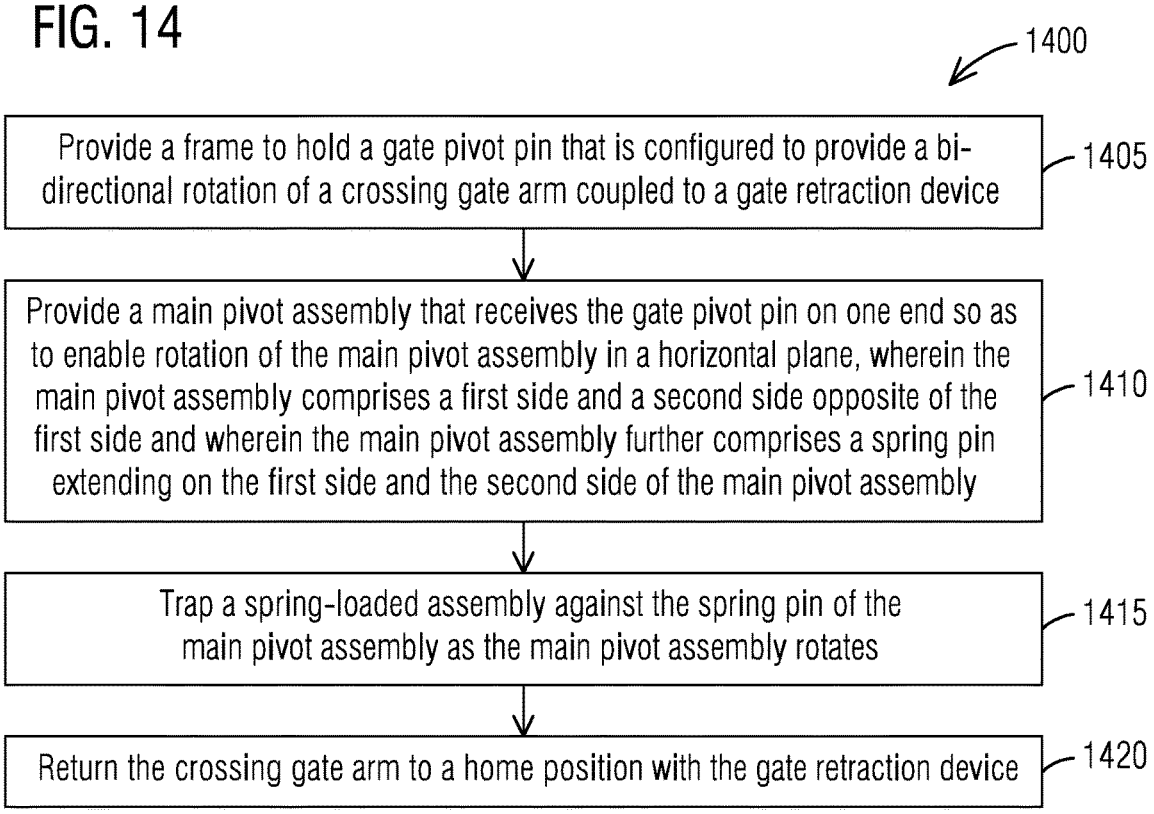
FIG. 14 illustrates a flow chart of a method of returning a crossing gate arm to a home position with a gate retraction device according to one exemplary embodiment of the present invention.

FIG. 14 illustrates a flow chart of a method 1400 of returning the crossing gate arm 7 of FIG. 1 to the home position 505 of FIG. 5 with the spring-loaded gate return or retraction device 200 of FIG. 2 according to one exemplary embodiment of the present invention. Reference is made to the elements and features described in FIGS. 1-13. It should be appreciated that some steps are not required to be performed in any particular order, and that some steps are optional.

In step 1405, the method 1400 comprises providing the frame 205 to hold the gate pivot pin 207 that is configured to provide a bi-directional rotation of the crossing gate arm 7. The method 1400 further comprises a step 1410 of providing the main pivot assembly 210 that receives the gate pivot pin 207 on one end so as to enable rotation of the main pivot assembly 210 in a horizontal plane. The main pivot assembly 210 comprises the first side 215(1) and the second side 215(2) opposite of the first side 215(1). The main pivot assembly 210 further comprises the spring pin 217 extending on the first side 215(1) and the second side 215(2) of the main pivot assembly 210.

The method 1400 further comprises a step 1415 of trapping the spring-loaded assembly 220 against the spring pin 217 of the main pivot assembly 210 as the main pivot assembly 210 rotates. The method 1400 further comprises a step 1420 of returning the crossing gate arm 7 to the home position 505 with the spring-loaded gate return or retraction device 200.

The spring-loaded gate return or retraction device 200 has increased a range of motion from 45 to 60 degrees each direction if the gate arm 7 is struck. The springs 225 does not pop out of a groove and the spring-loaded gate return or retraction device 200 can return a 40' arm to the home position 505 when rotated 60 degrees and with the gate mechanism 60 degrees from horizontal. This spring-loaded gate return or retraction device 200 is similar to a typical gate saver in which a maintenance swivel has been added to the design. The spring-loaded gate return or retraction device 200 is strong enough that shear pins are not needed.

The spring-loaded gate return or retraction device 200 has increased the range of motion from 45 to 60 degrees each direction by moving a main pivot point forward (away from the gate), angling the end plates 235 rearward and having a deeper detent 710 in the ramp 707 to increase break away force and reduce un-intended operation due to high winds in the vertical position. This allows the spring-loaded gate return or retraction device 200 to eliminate the need for a shear pin (maintainer not needed to reinstall a new shear pin). The spring-loaded gate return or retraction device 200 has ramp angles, coil spring rates and the rubber spring that are able to return 40' gate arms from 60 degrees from vertical and horizontal. The spring-loaded gate return or retraction device 200 catches the springs 225 upon rotation of the unit and keeps the spring 225 centered to the end plates 235 for constant spring compression during rotation.

The spring-loaded gate return or retraction device 200 restores the crossing gate arm 7 to the home position 505 in the event it was hit by a motor vehicle. It consists of machined aluminum channels, angles end plates for aligning and holding the coil springs 225, a supported central pivot shaft with a roller that fits into a detent 710 in the ramp 707. As force is applied to the gate arm 7, the rubber spring 705 must be compressed in order for the roller 935 to move out of a ramp 707 notch or the detent 710 (home position) and compress one of the coil springs 225. The force of the springs 225 is trying to return the gate arm 7 to the home position 505 once the applied force on the gate arm 7 is removed.

The distance between the top and bottom channels 600 and the mounting hole locations in these channels 600 configured to able to fit different brands of crossing gate counter weight support arms. In this way, the springs 225 are properly captured and compressed as the gate arm 7 rotates.

The advantages and benefits of the spring-loaded gate return or retraction device 200 are such that gate arm rotation has been increased from 45 to 60 degrees. The springs 225 has increased rotational travel and along with the changes in the detent 710 in the ramp 707 and ramp angle changes, the spring-loaded gate return or retraction device 200 can return a 40' gate arm to the home position 505 if struck and rotated 60 degrees while also moving 60 degrees up from horizontal. Other designs needed to use a shear pin (optional) to increase the initial force of movement (assuming high winds or long gate arms in the vertical position). The spring-loaded gate return or retraction device 200 has a deeper notch or detent 710 in the ramp 707, ramp angle and the spring 225 characteristics increase the initial force to move such that a shear pin is not needed. This makes the unit maintenance free as service is not needed to replace a pin once activated. The springs 225 are used in a way that prevents the spring 225 from sliding or popping out of a notch and preventing failures in the field.

For example, a motor vehicle hits the gate arm 7 when the gate arm 7 is horizontal to the road. This force on the gate arm 7 rotates about the gate pivot pin 207 and compresses the coil spring 225. The spring 225 coil gets trapped by the spring pin 217 and the side of the pivot arm above. The spring pin 217 is disposed forward and perpendicular to the gate pivot pin 207. The centering washer 405 may be slightly smaller in a diameter than an internal diameter of the coil spring 225 to hold its location.

While a powered gate is described here a range of other constructions of a gate mechanism and a gate arm are also contemplated by the present invention. For example, other types of crossing gate mechanisms and gate arms may be implemented based on one or more features presented above without deviating from the spirit of the present invention.

The techniques described herein can be particularly useful for a coil spring-loaded assembly for a gate return or retraction device. While particular embodiments are described in terms of the coil spring-loaded assembly, the techniques described herein are not limited to the coil spring-loaded assembly but can also be used with other retraction or return devices.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A spring-loaded gate retraction device to return a rail-road crossing gate arm, the spring-loaded gate retraction device comprising:

a frame to hold a gate pivot pin that is configured to provide a bi-directional rotation of the rail-road crossing gate arm;

a main pivot assembly that receives the gate pivot pin on one end so as to enable rotation of the main pivot assembly in a horizontal plane substantially parallel to a ground surface of a road, wherein the main pivot assembly comprises a first side and a second side opposite of the first side, wherein the main pivot assembly further comprises a pin extending on the first side and the second side of the main pivot assembly, and wherein the pin having a first length on the first side of the main pivot assembly and a second length on the second side of the main pivot assembly;

a first spring having a first end and a second end, the first spring is disposed horizontally lengthwise on the first side of the main pivot assembly and coupled to the frame on the first end of the first spring and detachably coupled to the first length of the pin of the main pivot assembly on the second end of the first spring; and a second spring having a first end and a second end, the second spring is disposed horizontally lengthwise on the second side of the main pivot assembly and coupled to the frame on the first end of the second spring and detachably coupled to the second length of the pin of the main pivot assembly on the second end of the second spring, wherein the frame further comprising:

a first end plate angled rearwards towards a centerline of the spring-loaded gate retraction device to receive the first end of the first spring;

a second end plate angled rearwards towards the centerline of the spring-loaded gate retraction device to receive the first end of the second spring;

a first clip and a second clip;

a first centering washer coupled to the first end plate to hold position of the first spring with the first clip by keeping the first spring from moving on the first end plate; and a second centering washer coupled to the second end plate to hold position of the second spring with the second clip by keeping the second spring from moving on the second end plate.

2. The spring-loaded gate retraction device of claim 1, wherein the first spring is trapped against the pin of the main pivot assembly as the main pivot assembly rotates.

3. The spring-loaded gate retraction device of claim 2, wherein the second spring is trapped against the pin of the main pivot assembly as the main pivot assembly rotates.

4. The spring-loaded gate retraction device of claim 1, wherein the pin of the main pivot assembly is located near a center at a middle of a longitudinal length of the main pivot assembly.

5. The spring-loaded gate retraction device of claim 1, wherein the first spring and the second spring are a coil spring.

6. The spring-loaded gate retraction device of claim 1, wherein the frame further comprising:

a first channel and a second channel, wherein each channel of the first and second channels having a first flange and a second flange such that a pivot point of the gate pivot pin is closer to the first flange of the first channel.

7. The spring-loaded gate retraction device of claim 1, wherein the gate pivot pin provides a 60 degree rotation in a left direction from a home position of 0 degree and a 60 degree rotation in a right direction from the home position.

8. The spring-loaded gate retraction device of claim 1, wherein the rail-road crossing gate arm is detachably coupled to the main pivot assembly such that the rail-road crossing gate arm is removable from the main pivot assembly so that the main pivot assembly can swivel during arm maintenance.

9. A gate retraction device to return a crossing gate arm, the gate retraction device comprising:

a frame to hold a gate pivot pin that is configured to provide a bi-directional rotation of the crossing gate arm;

a main pivot assembly that receives the gate pivot pin on one end so as to enable rotation of the main pivot assembly in a horizontal plane, wherein the main pivot assembly comprises a first side and a second side opposite of the first side and wherein the main pivot assembly further comprises a spring pin extending on the first side and the second side of the main pivot assembly; and a spring-loaded assembly trapped against the spring pin of the main pivot assembly as the main pivot assembly rotates, wherein the frame further comprising:

a first end plate angled rearwards towards the centerline of the spring-loaded gate retraction device to receive the first end of the first spring;

a second end plate angled rearwards towards the centerline of the spring-loaded gate retraction device to receive the first end of the second spring;

a first clip and a second clip;

a first centering washer coupled to the first end plate to hold position of the first spring with the first clip by keeping the first spring from moving on the first end plate; and a second centering washer coupled to the second end plate to hold position of the second spring with the second clip by keeping the second spring from moving on the second end plate, wherein the first spring and the second spring are a coil spring, and wherein the main pivot assembly further comprising:

a roller assembly including a yoke and a roller such that a pin going through the yoke holds the roller assembly in place.

10. The gate retraction device of claim 9, wherein the spring pin having a first length on the first side of the main pivot assembly and a second length on the second side of the main pivot assembly and wherein the spring-loaded assembly comprises:

a first spring having a first end and a second end, the first spring is disposed horizontally lengthwise on the first side of the main pivot assembly and coupled to the frame on the first end of the first spring and detachably coupled to the first length of the pin of the main pivot assembly on the second end of the first spring; and a second spring having a first end and a second end, the second spring is disposed horizontally lengthwise on the second side of the main pivot assembly and coupled to the frame on the first end of the second spring and detachably coupled to the second length of the pin of the main pivot assembly on the second end of the second spring.

11. The gate retraction device of claim 9, wherein the spring pin of the main pivot assembly is located near a center at a middle of a longitudinal length of the main pivot assembly.

12. A spring-loaded gate retraction device to return a rail-road crossing gate arm, the spring-loaded gate retraction device comprising:

a frame to hold a gate pivot pin that is configured to provide a bi-directional rotation of the rail-road crossing gate arm;

a main pivot assembly that receives the gate pivot pin on one end so as to enable rotation of the main pivot assembly in a horizontal plane substantially parallel to a ground surface of a road, wherein the main pivot assembly comprises a first side and a second side opposite of the first side, wherein the main pivot assembly further comprises a pin extending on the first side and the second side of the main pivot assembly, wherein the pin having a first length on the first side of the main pivot assembly and a second length on the second side of the main pivot assembly, and wherein the main pivot assembly further comprises a roller assembly including a yoke and a roller such that a pin going through the yoke holds the roller assembly in place;

a first spring having a first end and a second end, the first spring is disposed horizontally lengthwise on the first side of the main pivot assembly and coupled to the frame on the first end of the first spring and detachably coupled to the first length of the pin of the main pivot assembly on the second end of the first spring; and a second spring having a first end and a second end, the second spring is disposed horizontally lengthwise on the second side of the main pivot assembly and coupled to the frame on the first end of the second spring and detachably coupled to the second length of the pin of the main pivot assembly on the second end of the second spring.

13. The spring-loaded gate retraction device of claim 12, further comprising:

a rubber spring; and a ramp having a detent such that the roller of the roller assembly fits into the detent, wherein when a force is applied to the rail-road crossing gate arm the rubber spring is compressed in order for the roller to move out of the ramp and compress one of the first spring or the second spring.

14. A gate retraction device to return a crossing gate arm, the gate retraction device comprising:

a frame to hold a gate pivot pin that is configured to provide a bi-directional rotation of the crossing gate arm;

a main pivot assembly that receives the gate pivot pin on one end so as to enable rotation of the main pivot assembly in a horizontal plane, wherein the main pivot assembly comprises a first side and a second side opposite of the first side and wherein the main pivot assembly further comprises a spring pin extending on the first side and the second side of the main pivot assembly;

a spring-loaded assembly trapped against the spring pin of the main pivot assembly as the main pivot assembly rotates;

a rubber spring; and a ramp having a detent such that the roller of the roller assembly fits into the detent, wherein when a force is applied to the rail-road crossing gate arm the rubber spring is compressed in order for the roller to move out of the ramp and compress one of the first spring or the second spring, wherein the frame further comprising:

a first channel and a second channel, wherein each channel of the first and second channels having a first flange and a second flange such that a pivot point of the gate pivot pin is closer to the first flange of the first channel, wherein the gate pivot pin provides a 60 degree rotation in a left direction from a home position of 0 degree and a 60 degree rotation in a right direction from the home position, and wherein the crossing gate arm is detachably coupled to the main pivot assembly such that the rail-road crossing gate arm is removable from the main pivot assembly so that the main pivot assembly can swivel during arm maintenance.

* * * * *